US007249592B2

(12) United States Patent
Yaguchi

(10) Patent No.: US 7,249,592 B2
(45) Date of Patent: Jul. 31, 2007

(54) DELIVERY PIPE FOR FUEL INJECTION DEVICE

(75) Inventor: Yasuhiro Yaguchi, Koga (JP)

(73) Assignee: Sanoh Industrial Co., Ltd., Koga-shi, Ibaraki-ken (JP)

( * ) Notice: Subject to any disclaimer, the term of this patent is extended or adjusted under 35 U.S.C. 154(b) by 7 days.

(21) Appl. No.: 10/547,176

(22) PCT Filed: Dec. 26, 2003

(86) PCT No.: PCT/JP03/16889

§ 371 (c)(1),
(2), (4) Date: Feb. 16, 2006

(87) PCT Pub. No.: WO2004/081369

PCT Pub. Date: Sep. 23, 2004

(65) Prior Publication Data

US 2006/0196477 A1 Sep. 7, 2006

(30) Foreign Application Priority Data

Mar. 11, 2003 (JP) ..... 2003-064261

(51) Int. Cl.
*F02M 55/02* (2006.01)

(52) U.S. Cl. ..... 123/456; 123/468

(58) Field of Classification Search ..... 123/456, 123/468, 469

See application file for complete search history.

(56) References Cited

U.S. PATENT DOCUMENTS 4,457,280 A * 7/1984 Hudson, Jr. ..... 123/470
4,519,368 A * 5/1985 Hudson, Jr. ..... 123/468
4,751,904 A * 6/1988 Hudson, Jr. ..... 123/470
5,090,385 A * 2/1992 Usui et al. ..... 123/468
5,261,145 A * 11/1993 Jennings ..... 24/20 R (Continued)

FOREIGN PATENT DOCUMENTS

JP 63-109886 7/1988

(Continued)

*Primary Examiner*—Thomas Moulis
(74) *Attorney, Agent, or Firm*—Pasz Law Group, PLC; R. Eugene Varndell, Jr.

(57) ABSTRACT

An object of the invention is to provide a fuel injector delivery pipe which does not require a tool for holding an upper part and lower part together, and thereby eliminate the process of attaching and removing the tool, and increases the efficiency of the operation. Furthermore, in order to achieve this object, the fuel injector delivery pipe comprises an upper part 2 with an inverted substantially U-shaped vertical cross-section in the longitudinal direction formed with a top wall 2*a* and two side walls 2*b*, 2*b*, and also comprises a lower part 3 with a substantially U-shaped vertical cross-section in the longitudinal direction with a bottom wall 3*a* and two side walls 3*b*, 3*b*. Locking parts 5, 10 are formed in both side walls 2*b*, 2*b* of the upper part 2 and in both side walls 3*b*, 3*b* of the lower part 3 respectively for locking together the walls, and the locking parts 5, 10 are locked together to temporarily lock the upper part 2 and the lower part 3 together while the parts are integrated by brazing.

1 Claim, 3 Drawing Sheets

U.S. PATENT DOCUMENTS

| | | | | |
|---|---|---|---|---|
| 5,924,457 | A | 7/1999 | Inaba et al. | |
| 6,324,761 | B1 | 12/2001 | Mashiko et al. | |
| 6,341,595 | B1 * | 1/2002 | Scollard et al. | 123/456 |
| 6,374,865 | B1 | 4/2002 | Mashiko et al. | |
| 6,615,801 | B1 * | 9/2003 | Zdroik | 123/467 |
| 2003/0221672 | A1 * | 12/2003 | Zdroik et al. | 123/456 |
| 2005/0133008 | A1 * | 6/2005 | Zdroik et al. | 123/456 |

FOREIGN PATENT DOCUMENTS

| | | | |
|---|---|---|---|
| JP | 11-14284 | A | 1/1999 |
| JP | 11-22575 | A | 1/1999 |
| JP | 2001-207934 | A | 8/2001 |

* cited by examiner

DELIVERY PIPE FOR FUEL INJECTION DEVICE

TECHNICAL FIELD

The present invention relates to a fuel injector delivery pipe, and more particularly to a fuel injector delivery pipe formed from an upper part which has an inverted substantially U-shaped vertical cross-section in the longitudinal direction and a lower part with a substantially U-shape which are overlapping at the side walls of the parts, and the overlapping regions are integrated together by brazing.

BACKGROUND ART

Fuel injection type internal combustion engines temporarily store fuel from the fuel pump in a delivery pipe, and supply fuel to each of the injectors by means of the delivery pipe.

These delivery pipes comprise an upper part with a substantially inverted U-shaped vertical cross-section in the longitudinal direction with a top wall and two side walls, and a lower part with a substantially U-shaped vertical cross-section in the longitudinal direction with a bottom wall and two side walls. The side walls of the upper part and the side walls of the lower part are overlapped and mated together, and the overlapped regions are integrated by brazing. (Refer to Japanese Patent Application Laid Open No. H11-22575 or 2001-207934 for example.) Incidentally, the capacity of the delivery pipe for fuel injectors must be fixed at a certain capacity in order to prevent variation between engines caused by the amount of fuel supplied to the injectors.

However, with the aforementioned conventional delivery pipes, the edge of the sides of one part such as the upper part is inserted and contacts the bottom wall of the lower part to set the mutually position of the upper part and the lower part, and then in this condition, both parts are joined by brazing, and therefore, when heated, the region of contact may lift up and the desired standard capacity may not be obtained.

Therefore, with the conventional delivery pipe, when brazing, a tool is used to hold the upper part and the lower part together, and thereby lifting caused by heating can be prevented.

Therefore, during the delivery by brazing process, an operation to attach the tool and an operation to remove the tool are necessary, and therefore the operation is complex.

With the foregoing in view, an object of the present invention is to provide a fuel injector delivery pipe which increases the efficiency of the operation by eliminating the need for a tool to hold the upper part and the lower part together and thus eliminating the operation of attaching the tool and removing the tool.

DISCLOSURE OF THE INVENTION

In order to achieve the aforementioned object, the fuel injector delivery pipe characterized by comprising an upper part with a substantially inverted U-shaped vertical cross-section in the longitudinal direction formed with a top wall and two side walls, and a lower part with a substantially U-shaped vertical cross-section in the longitudinal direction formed with a bottom wall and two side walls, and the fuel injector delivery pipe is characterized in that locking parts are formed in both side walls of the upper part and in both side walls of the lower part for mutually locking together the walls, and the locking parts are locked together to temporarily retain the upper part and the lower part together which are then integrated by brazing, and the fuel injector delivery pipe is characterized in that the locking part comprises recesses or holes, formed in one of the overlapping side wall surfaces, and protrusions which engage with the recesses or holes formed in the other overlapping side wall surface, and the recesses or holes are formed to be appropriately longer in the longitudinal direction of the delivery Pipe than the protrusions.

With the present invention, the upper part and the lower part are locked together by the locking parts in the respective side walls. Therefore, during brazing, the positional relationship of the upper part and the lower part will not shift during heating and a delivery pipe with the desired rated capacity can be obtained.

BEST MODE FOR CARRYING OUT THE INVENTION

Figure 1:
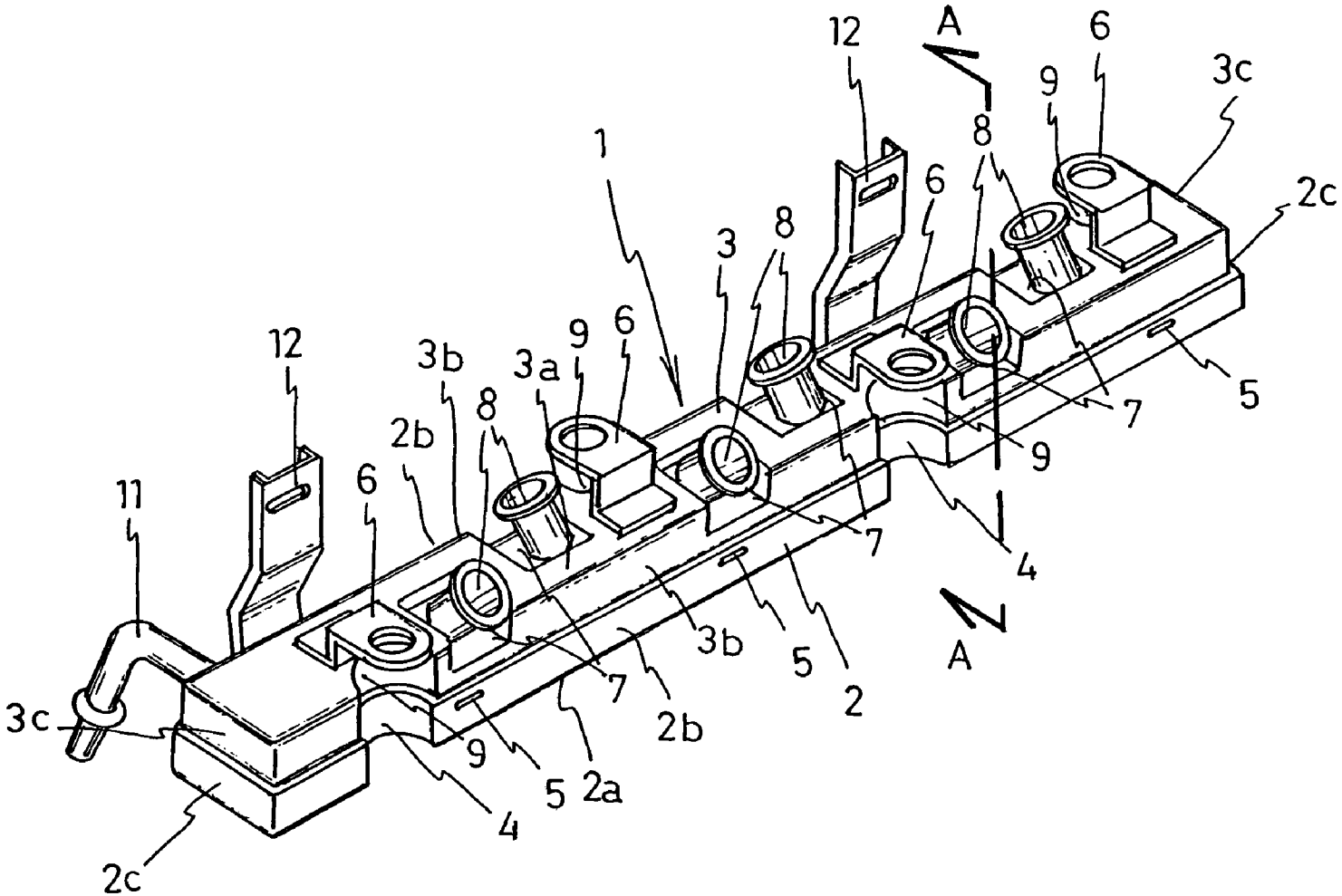
FIG. 1 is a perspective view showing the fuel injector delivery pipe of the present invention, and in the figure, the lower part is shown on top and the upper part is shown below.

The present invention will be described below based on the preferred embodiments shown in the drawings.

This delivery pipe has a case 1 comprising an upper part 2 and a lower part 3.

Figure 2:
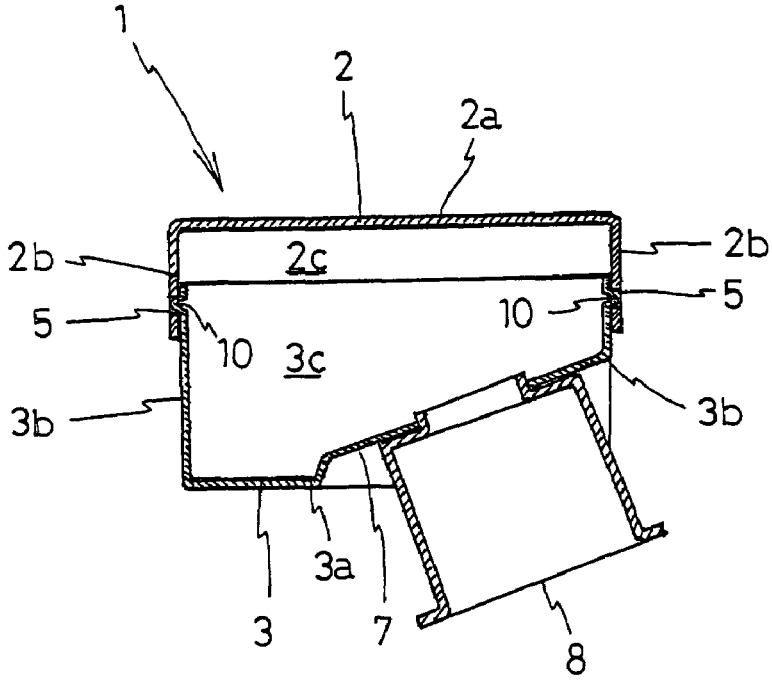
FIG. 2 is a cross-section view of the section along line A-A in FIG. 1, and in this figure, the lower part is shown on the bottom and the upper part shown on the top.

The upper part 2 has a vertical cross-section in the longitudinal direction of the case 1 which forms an inverted substantially U-shape as shown in FIG. 2, and thereby is comprising a top wall 2*a* and two side walls 2*b*, 2*b*. Furthermore, end walls 2*c*, 2*c* are formed at both ends in the longitudinal direction of the upper part 2.

Similarly, the lower part 3 also has a vertical cross-section in the longitudinal direction of the case 1 which forms a substantially U-shape as shown in FIG. 2, and thereby is comprising a bottom wall 3*a*, and two side walls 3*b*, 3*b*. Furthermore, end walls 3*c*, 3*c* are formed at both ends in the longitudinal direction of the lower part 3.

As shown in FIG. 1, the upper part 2 has a plurality of half arc shaped recesses 4 (2 in each for this embodiment) formed in both of the side walls 2*b*, 2*b* extending to the top wall 2*a*.

Figure 3:
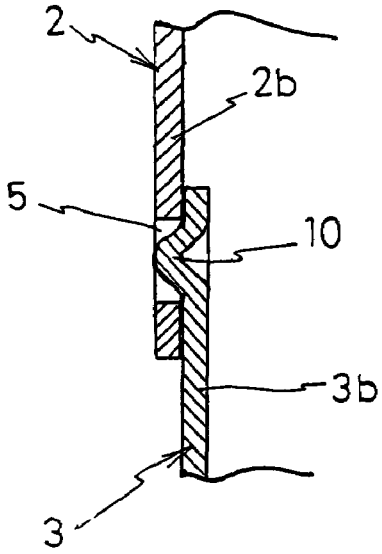
FIG. 3 is an enlarged cross-section view showing the locking part of FIG. 2.

Furthermore, both side walls 2*b*, 2*b* of the upper part 2 have holes 5 and as shown in FIG. 2 and FIG. 3 in a plurality of locations (three locations each in this embodiment) as the locking part. These holes 5 may be circular, or elliptical with the length parallel to the longitudinal direction of the case as shown in FIG. 1, or even rectangular.

On one hand, as shown in FIG. 1, a plurality (four in this embodiment) of crank shaped brackets 6 are attached to the bottom wall 3*a* of the lower part 3, a plurality (three in this embodiment) of recesses 7 are formed all along the bottom wall 3*a* and one side wall 3*b*, and a plurality (three in this embodiment) of recesses 7 are formed along the bottom wall 3*a* and the other side wall 3*b*. Furthermore, as shown in FIG. 1 and FIG. 2, injector cups 8 pass through each of these recesses 7. Furthermore, a plurality (two in this embodiment) of half arc shaped recesses 9 are formed in one of the side walls 3*b*, and a plurality (two in this embodiment) of recesses 9 are also formed in the other side wall 3*b*.

Furthermore, as shown in FIG. 2 and FIG. 3, outward protruding protrusions 10 are formed as locking parts in each of a plurality (three each in this embodiment) of locations in both of the side walls 3*b*, 3*b* of the lower part 3. These protrusions 10 may be round, may be substantially elliptical extending in the longitudinal direction of the case 1, or may be rectangular.

The upper part 2 and lower part 3 which have this construction are mated together by inserting the side wall 3*b* and the end wall 3*c* of the lower part 3 into the side walls 2*b* and end walls 2*c* of the upper part 2, and as shown in FIG. 2, the protrusions 10 of the lower part 3 engage and lock together with the holes 5 of the upper part 2. Furthermore, in this condition, the upper part 2 and the lower part 3 are heated and brazed.

Furthermore, case 1 having this construction is mounted on the intake manifold by brackets 6, and the ends of the injectors (not shown in the drawings) which are attached to the injector cups 8 face into each of the channels in the intake manifold.

Note, in FIG. 1, number 11 identifies a fuel supply line which is attached to the side wall or the like of the case 1, and number 12 identifies a bracket which supports the wire harness or the like.

Figure 4:
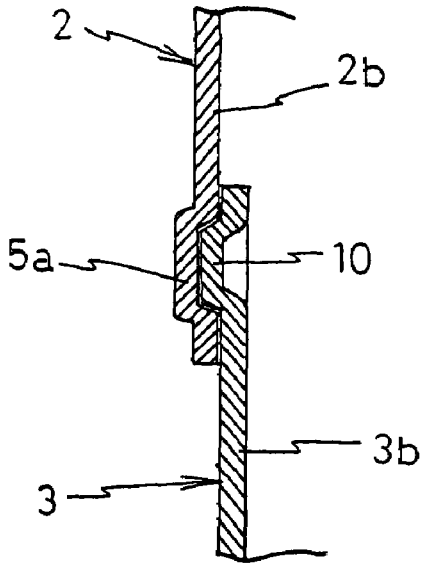
FIG. 4 is a cross-section view showing another embodiment of the locking part of the present invention.

In the aforementioned embodiment, holes 5 are formed in the side walls 2*b* of the upper part 2 as one side of the locking part which forms a locking means for locking together the side walls 2*b* of the upper part 2 and the side walls 3*b* of the lower part 3, but as shown in FIG. 4, recesses 5*a* may replace these holes 5.

Furthermore, in the aforementioned embodiment, holes 5 are formed in the upper part 2, and protrusions 10 are formed in the lower part 3, but it is also acceptable for protrusions to be formed in the upper part 2, and holes or recesses to be formed in the lower part 3.

Furthermore, the holes or recesses of the aforementioned locking part are large enough to accommodate the protrusions which engage therein, and preferably are slightly larger than the protrusions to make as tight of a fit as possible, but may be appropriately longer than the protrusions in the longitudinal direction of the case 1. With this construction, even if there is a small amount of manufacturing error between the parts in the longitudinal direction, the corresponding protrusions will positively be able to engage.

Figure 5:
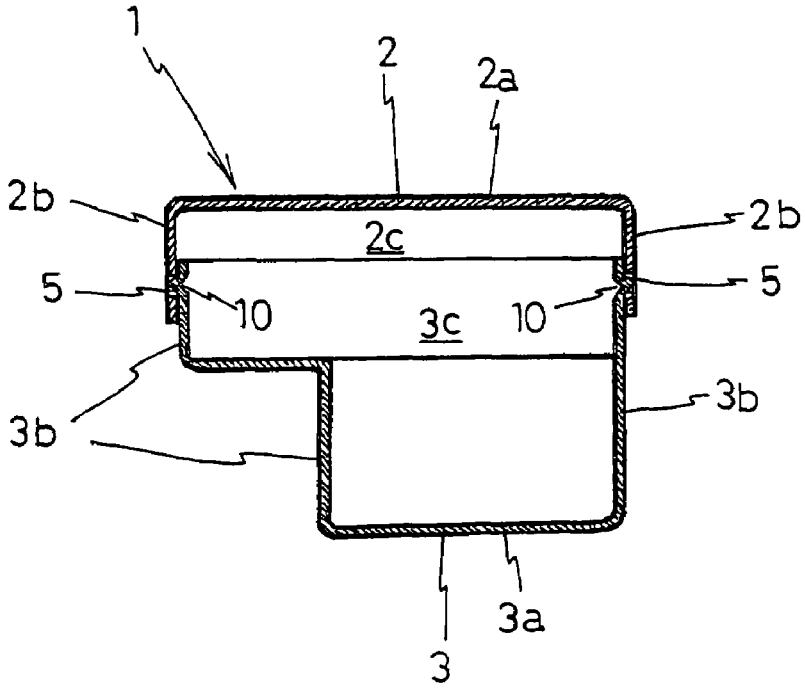
FIG. 5 is a cross-section view showing another embodiment of the upper part and lower part of the present invention.

Furthermore, the substantially U-shaped cross-section or the inverted substantially U-shaped cross-section referred to in this invention also includes the shape of the lower part 3 which has a step midway as shown in FIG. 5.

INDUSTRIAL APPLICABILITY

The fuel injector delivery pipe of the present invention described above can be appropriately used as a delivery pipe for a fuel injector type internal combustion engine which temporarily stores fuel from the fuel pump in a delivery pipe and supplies the fuel to each of the injectors through this delivery pipe.

The invention claimed is:

1. A fuel injector delivery pipe comprising an upper part with a substantially inverted U-shaped vertical cross-section in the longitudinal direction formed with a top wall and two side walls, and a lower part with a substantially U-shaped vertical cross-section in the longitudinal direction formed with a bottom wall and two side walls, the fuel injector delivery pipe including locking parts formed in both side walls of the upper part and in both side walls of the lower part for mutually locking together the walls, and the locking parts being locked together to temporarily retain the upper part and the lower part together which are then integrated by brazing, and the locking parts comprising recesses or holes, formed in one of overlapping side wall surfaces of the upper and lower parts, and protrusions which engage with the recesses or holes formed in another of the overlapping side wall surfaces of the upper and lower parts, and the recesses or holes being longer in the longitudinal direction of the delivery pipe than the protrusions.

* * * * *